United States Patent [19]

Goddard et al.

[11] 4,416,321

[45] Nov. 22, 1983

[54] METHOD OF MANUFACTURE OF ARTICLES WITH INTERNAL PASSAGES THEREIN AND ARTICLES MADE BY THE METHOD

[75] Inventors: John Goddard; David Mills, both of Bristol, England

[73] Assignee: Rolls Royce Limited, London, England

[21] Appl. No.: 280,213

[22] Filed: Jul. 6, 1981

[30] Foreign Application Priority Data

Jul. 17, 1980 [GB] United Kingdom ..... 8023396

[51] Int. Cl.[3] ..... B22D 23/06; B22D 27/04

[52] U.S. Cl. ..... 164/80; 164/122.1

[58] Field of Search ..... 164/80, 122.1, 122.2, 164/122, 123–128

[56] References Cited

FOREIGN PATENT DOCUMENTS 521828 2/1956 Canada ..... 164/122.1

51-18224 6/1976 Japan ..... 164/80

*Primary Examiner*—Kuang Y. Lin

*Attorney, Agent, or Firm*—Parkhurst & Oliff

[57] ABSTRACT

In casting of hollow turbine blades problems arise with breakage or distortion of long thin cores for small diameter cooling passages, and also in maintaining cores accurately positioned for casting thin walled blades. The present invention provides a method of manufacture in which a pre-form of the blade, or other hollow article, is made in two parts and is accurately machined to define the required passage shapes or wall thicknesses in at least one of the parts, appropriate cores are made and the pre-form parts are assembled in a casting mould with the cores in position and heated to melt the pre-forms. Thus the cores are supported by solid material during the melting process. The melting can take place progressively in a uni-directional manner along the article so that only a narrow area of the article becomes melted at any time and the cores are supported in the melt from both ends. Thus columnar grained or single crystal articles can be made by this method. The method can also be used to produce blind-ended holes in a cast article.

5 Claims, 4 Drawing Figures

Figure 1:
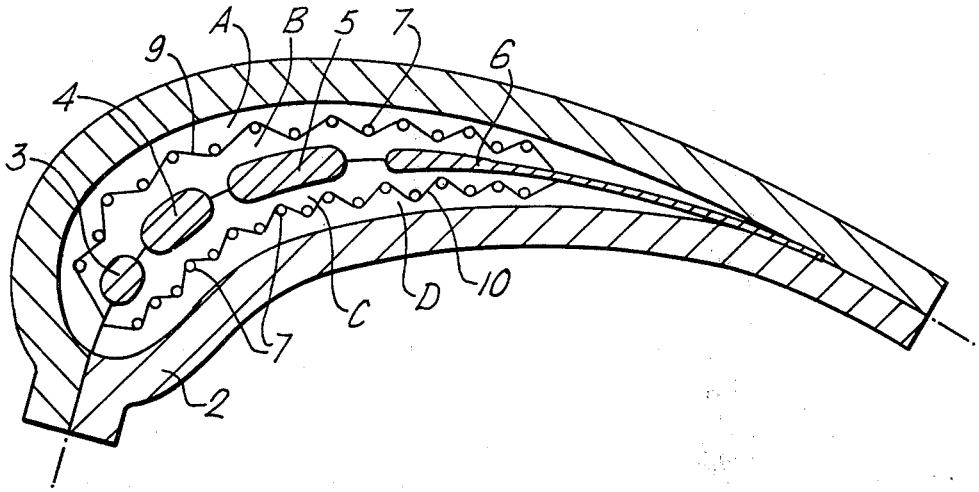

METHOD OF MANUFACTURE OF ARTICLES WITH INTERNAL PASSAGES THEREIN AND ARTICLES MADE BY THE METHOD

DESCRIPTION

The present invention relates to manufacture of articles having internal passages therein, and relates particularly but not exclusively to a method of casting of turbine blades with internal passages therein.

In one form of cooled turbine blade for high temperature use the blade is provided with one or more relatively large main cooling passages extending longitudinally therethrough and further cooling passages of much smaller cross-sectional area which also extend longitudinally through the walls of the blade or generally transversely from the main passages.

For high cooling efficiency a high velocity is required in the air flow through the passages in the blade walls, so that it is preferable to keep the cross-sectional areas of these passages as small as possible. However, when casting the blades, the cores are supported by the mould material only at the root and tip ends of the blade cavity, leaving relatively long lengths of thin cores unsupported. This leads to significant scrap rates in finished cast blades due to breakage of the cores as the metal impacts on them during pouring, and also due to distortion of the cores in the period during which they are held at high temperature during casting. This is a particular problem in casting directionally solidified blades, because in this process the mould is maintained at a higher temperature for a longer period than in a conventional casting.

It is often desirable also to make blades for gas turbine engines hollow for lightness, even where no cooling is required, and in such blades it is also desirable for the same reason to keep the walls as thin as possible. This necessitates the accurate positioning of a core within a mould, and where the blade has a high length/chord ratio the tolerance on the core position is high. Thus the finished blades often have unnecessarily thick wall sections with a consequent weight penalty on the engine.

The present invention seeks to eliminate these problems and is characterised in that the article is made in two steps, in the first of which a pre-form is made of the article in one or more pieces, and the passages are at least partially formed in one or more of the pieces of the pre-form. The cores are then positioned in the partially formed passages, and the pre-form and cores are assembled in a casting mould and melted to form the cast article.

By this means the impact of molten material on the cores which occurs during a normal pouring operation is avoided, and the cores are supported along their lengths by solid material during the heating of the mould until the point of melting is reached. The causes of breakage and distortion are thus substantially eliminated.

Further improvements in the process may also be made to provide other additional advantages. For example, the mould may be heated in a progressive, unidirectional manner from one end, as is known in a zone refining process. By this means even when part of the casting is molten, the cores are supported over a substantial part of their lengths at each end by solid material. Thus they are supported at one end by the mateiral of the pre-form as yet unmelted, and at the other end by being embedded in newly solidified material. The method of the invention can also be utilized to produce castings with columnar crystals or single cyrstals and provided far better core support than conventional processes for producing such castings with the consequent reduction in scrap.

Other advantages can be gained by use of the method of the invention in casting articles with blind ended holes, and in joining articles which have been made in two parts, thus avoiding other joining processes such as brazing.

The pre-forms or parts thereof may be made in any convenient manner, for example by casting or conventional machining and the partially formed holes may be formed by any known suitable machining process.

Figure 2:
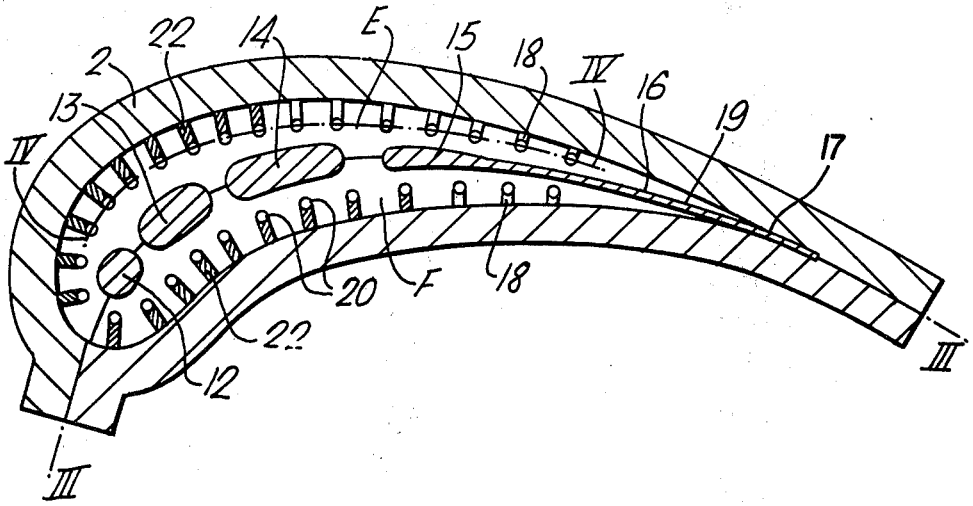
Figure 3:
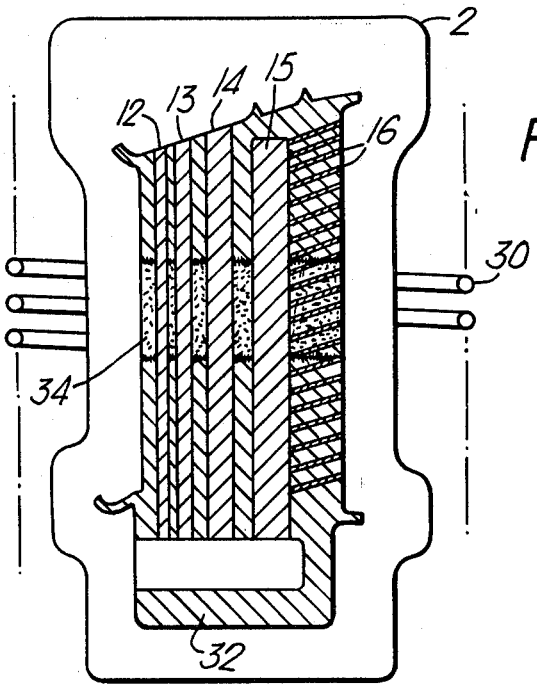
Figure 4:
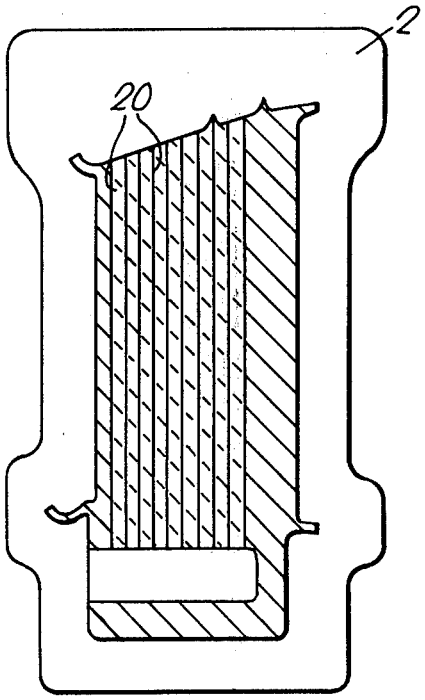

The invention will now be more particularly described, by way of example only, and with reference to the accompanying drawings, in which:

FIG. 1 is a transverse cross-section through a mould with an assembly of pre-form pieces and cores in accordance with one embodiment of the invention ready for melting to produce a turbine blade, FIG. 2 is a transverse cross-section of a mould including an assembly of pre-form pieces and cores illustrating an alternative pre-form construction for a turbine blade in accordance with the invention, FIG. 3 is a longitudinal cross-section reduced in size, on the chord line III—III of the blade of FIG. 2 illustrating an alternative melting technique in accordance with the invention, and, FIG. 4 is a longitudinal cross-section reduced in size on the line IV—IV of FIG. 2.

Referring now to the drawings there is shown in FIG. 1 a casting mould 2, shaped to produce a turbine blade and made in two parts which are arranged to meet together on a chord line of the blade. Assembled in the mould are four pieces A B C and D of a pre-form of the blade together with cores 3, 4, 5 and 6 for forming relatively large central cooling passages in the finished blade, and cores 7 for producing cooling holes of much smaller cross-sectional area in the blade wall.

The four pieces of the pre-form are cast, the pieces A and B being shaped to meet along the line 9, and the pieces C and D being shaped to meet along the line 10. At the required hole positions, open slots are machined along the length of the pre-form pieces, which, when closed by the surface of the adjacent pre-form piece, define the desired cross-sectional area of the hole.

With the cores in position in the holes in the pre-form the mould is put into a furnace and heated to melt the metal which flows gently around the cores to fill any clearances between the cores and the slots, and then the mould is removed from the furnace, the metal cooled and the cores leached out from the finished casting.

Clearly many variations are possible in the manner in which the pre-form is made. Parts B and C of the pre-form may be cast as one piece and the cores 3, 4, 5 and 6 left in position for re-melting. The slots for cores 7 may be formed on one or both surfaces of the pre-form to define the required hole shape to a greater or lesser extent in each pre-form as desired.

If significant clearances are left between the slots and the cores, i.e. if the slots are significantly oversize, it may be necessary to feed the mould with additional material during the melting process. FIG. 2 illustrates an alternative pre-form construction. In this example the pre-form is pre-cast in two pieces E and F each of which define portions of the main central cooling passages 12,13,14 and 15. Fine cooling passages are also provided leading from the passage 15 to exhaust at the trailing edge 17 of the blade, in addition to fine cooling passages extending longitudinally through the blade wall to exhaust at the blade tip.

To accomplish this, fine slots 16 are machined in one or both of the abutting faces of the pre-form pieces E and F and the slots 16 are arranged to extend both chordwise and radially outwardly. In addition fine longitudinal slots 18 are cut in the external surfaces of the pre-form pieces to the required depth. Cores 19,20 are made to the appropriate dimensions to give the required hole size in the finished blade, and these are fitted into the slots in the pre-form and the assembly put into the mould.

In order to fill those parts of the slots 18 not filled by the cores 20, a feed of additional blade material is provided from a feed cavity built into the mould and filled with bar stock when the mould is assembled. Alternatively, or in addition, filler pieces are made to fill the slots and thus become part of the pre-form assembly. Several such filler pieces are examplified by parts referenced 22 in FIG. 2.

Once again the mould is heated in a furnace to re-melt the pre-form to form a finished article and the melting material causes no damage or distortion to the cores due to the support given by the solid pre-form material for the greater part of the heating process.

As an alternative to heating the whole mould in a furnace so that all of the pre-form material becomes simultaneously molten, advantages can be gained by heating parts of the mould progressively from one end to the other, similar to zone refining, so that both ends of the cores are held and supported by solid metal while a part of the pre-form is melted.

This alternative embodiment of exemplified in FIGS. 3 and 4. The mould is heated in a furnace by means of a coil 30 of short axial length which is movable longitudinally along the mould. The heating is started at the root end 32 of the blade, at which time the cores are supported in the slots in the pre-form along substantially their whole length. Once a zone at the root of the blade is molten the heater coil is moved upwardly to melt more of the material in the mould leaving the newly melted material to cool and solidify. When the point illustrated in the drawing is reached where a central band 34 of material is molten it can be seen that each of the cores 20 is supported from both the root end, where they are embedded in newly solidified material, and the tip end, where they are still supported in the slots in the pre-form. This method gives still better support to the long thin cores since they are rigidly fixed in the newly solidified material.

The additional advantage to be gained by this process is the casting of blind ended holes. These may be blind at both ends for weight reduction, or at the tip in a turbine blade application for cooling air control. For example, one problem this solves is the loss of cooling air from the tips of blades through the core print which extends from the end of the core into the mould in a conventional casting. This leaves a hole extending from the cooling passage out of the tip of the blade. These holes are usually blocked by an end cap but this adds time and expense to the manufacture of the blade. By using the method of the invention the slots cut into the pre-form can be terminated short of the blade tip as shown with core 15. so that the resulting hole is blind. This enables more of the available cooling fluid pressure to be used to maintain a high flow velocity in the cooling fluid passages.

The method of the invention can also be used to advantage in casting turbine blades with columnar grains, or in the form of a single crystal. During these processes problems are experienced with conventional cores distorting due to the length of time they remain unsupported in the molten material.

The method of the invention has a still further advantageous use in the production of articles, particularly gas turbine engine blades by a two part process. This process is being increasingly adopted for production of turbine blades with complex patterns of cooling fluid passages. The process consists of casting the blades in two halves sometimes with some of the cooling fluid passages already formed, and then machining parts of the remaining passages in the confronting faces of the two halves before joining the two halves together by brazing, diffusion bonding or other joining technique. The problem with such a method is the accuracy with which the two faces being joined must be machined before joining to ensure a good joint and proper alignment of the joint faces.

By using the technique of the present invention cores can be inserted in the pre-formed passages and the blade pieces re-melted to join them together. Using this means the accuracy of machining on the faces is reduced thus reducing this part of the cost of the blade manufacture. The method of the invention then allows the two part blade to the re-cast as a single crystal blade thus combining the advantages of the strength of the single crystal blade with the advanced cooling patterns possible in the two part blade.

Where the method of the present invention is used to produce directionally solidified castings, for example, for the production of columnar grained or single crystal articles the mould may be used in conjunction with a chill plate and other conventional apparatus as required.

In place of the heater coil 30 shown in FIG. 3, other convenient forms of heating may be used. It is preferable that the melted zone should be as narrow as possible and lasers or electron beams would enable this to be done. Alternatively a radient heater such as a resistance heater may be used.

In order to produce a cast hollow thin-walled blade, the blade may be made in two halves by finish casting the appropriately shaped pieces and assembling them in a mould with an appropriately shaped core for re-melting, or less accurate pre-forms can be made with accurate external dimensions only, and the confronting surfaces can be shaped by machining before assembly with the core.

We claim:

1. A method of making an article having one or more internal passages therein comprises the steps of:

(a) making a pre-form of the article in at least two pieces, with each passage at least partially formed in one or more of the pieces of the pre-form, (b) making one or more casting cores each of appropriate shape to define a required passage in the finished article, (c) assembling the pre-form and the cores in a predetermined position in a casting mould, and (d) heating the pre-form to a sufficient temperature to melt it and thereafter allowing it to cool to form the finished article.

2. A method as claimed in claim 1 and in which the pre-form pieces are individually cast.

3. A method as claimed in claim 1 and in which the melting step is carried out in a progressive uni-directional manner to create a zone of melted material which moves progressively along the mould.

4. A method as claimed in claim 1 and in which the material after being melted is cooled in a uni-directional manner.

5. A method according to claim 1 and in which at least one core in the assembly extends into but not entirely through the pre-form so that the finished article includes one blind ended hole.

* * * * *